US009366476B2

(12) United States Patent
Tuo et al.

(10) Patent No.: US 9,366,476 B2
(45) Date of Patent: Jun. 14, 2016

(54) CONDENSER-REBOILER SYSTEM AND METHOD WITH PERFORATED VENT TUBES

(71) Applicants: Hanfei Tuo, East Amherst, NY (US); Karl K. Kibler, Amherst, NY (US); Maulik R. Shelat, Wiliamsville, NY (US)

(72) Inventors: Hanfei Tuo, East Amherst, NY (US); Karl K. Kibler, Amherst, NY (US); Maulik R. Shelat, Wiliamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 0 days.

(21) Appl. No.: 14/947,466

(22) Filed: Nov. 20, 2015

(65) Prior Publication Data

US 2016/0076809 A1 Mar. 17, 2016

Related U.S. Application Data

(63) Continuation-in-part of application No. 14/167,339, filed on Jan. 29, 2014.

(51) Int. Cl.
*F25J 3/04* (2006.01)
*F25J 5/00* (2006.01)

(52) U.S. Cl.
CPC ..... *F25J 3/04412* (2013.01); *F25J 5/005* (2013.01); *F25J 2200/06* (2013.01); *F25J 2250/02* (2013.01); *F25J 2250/04* (2013.01); *F25J 2290/32* (2013.01); *F25J 2290/44* (2013.01); *F28F 2265/12* (2013.01)

(58) Field of Classification Search
CPC .. F25J 2250/02; F25J 2250/20; F25J 2290/32
USPC ..... 165/111, 114, DIG. 207, DIG. 208
See application file for complete search history.

(56) References Cited

U.S. PATENT DOCUMENTS

| | | | | |
|---|---|---|---|---|
| 946,238 | A * | 1/1910 | Loomis | F28B 1/02 122/32 |
| 2,044,372 | A * | 6/1936 | Twomey | F25J 3/04412 165/111 |
| 2,181,704 | A * | 11/1939 | McNeal | F28D 7/1607 165/114 |
| 2,633,717 | A | 4/1953 | Paget | |
| 4,436,146 | A * | 3/1984 | Smolarek | F25J 3/04412 165/111 |

(Continued)

FOREIGN PATENT DOCUMENTS

| | | |
|---|---|---|
| DE | 767 216 | 3/1952 |
| DE | 1 551 583 | 6/1970 |

(Continued)

*Primary Examiner* — John F Pettitt
*Assistant Examiner* — Tareq Alosh
(74) *Attorney, Agent, or Firm* — Robert J. Hampsch

(57) ABSTRACT

A system and method for the concurrent condensation of a nitrogen-rich vapor and vaporization of an oxygen-rich liquid in a distillation column based air separation unit is provided. The disclosed system includes a condenser-reboiler heat exchanger located between a lower pressure column and a higher pressure column and configured to condense a nitrogen-rich vapor from the higher pressure column and partially vaporize an oxygen-rich liquid from the lower pressure column. Within the condenser-reboiler heat exchanger, the nitrogen-rich vapor flows in an upward direction such that any non-condensables present in the nitrogen-rich vapor will accumulate proximate the upper portion or top of the condenser-reboiler modules where they can be easily removed through venting by means of a venting apparatus having a plurality of perforated tubes.

12 Claims, 10 Drawing Sheets

(56) References Cited

U.S. PATENT DOCUMENTS

| | | | | |
|---|---|---|---|---|
| 4,918,944 | A * | 4/1990 | Takahashi | F25B 3/00 165/117 |
| 5,507,356 | A * | 4/1996 | Roth | B01D 3/14 165/111 |
| 5,699,671 | A * | 12/1997 | Lockett | B01D 5/0012 165/111 |
| 5,927,388 | A * | 7/1999 | Blangetti | F28B 1/02 165/110 |
| 6,196,023 | B1 | 3/2001 | Corduan et al. | |
| 6,351,968 | B1 | 3/2002 | Habicht et al. | |
| 6,393,866 | B1 | 5/2002 | Srinivasan et al. | |
| 7,421,856 | B2 | 9/2008 | Chakravarthy et al. | |
| 2007/0028649 | A1 | 2/2007 | Chakravarthy et al. | |

FOREIGN PATENT DOCUMENTS

| | | |
|---|---|---|
| DE | 1 949 609 | 4/1971 |
| DE | 2 102 976 | 8/1972 |
| FR | 2 929 532 A1 | 10/2009 |
| WO | WO 98/19122 | 5/1998 |
| WO | WO 99/39143 | 8/1999 |

* cited by examiner

CONDENSER-REBOILER SYSTEM AND METHOD WITH PERFORATED VENT TUBES

CROSS REFERENCE TO RELATED APPLICATIONS

The present application is a continuation-in-part (CIP) application and claims the benefit of and priority to U.S. patent application Ser. No. 14/167,339 filed on Jan. 29, 2014, the disclosure of which is incorporated by reference.

FIELD OF THE INVENTION

The present invention relates to a condensation and vaporization system for a cryogenic air separation unit. More particularly, the present invention is an improved condenser-reboiler system and method adapted to use an upward flow of nitrogen-rich vapor within the condenser-reboiler to condense the nitrogen-rich vapor and accumulate non-condensables at the top or upper region of the condenser-reboiler.

BACKGROUND

An important aspect of a cryogenic air separation system employing a distillation column is the condensation and vaporization system, and more particularly, the condensation of the higher pressure column vapor against reboiling of the lower pressure column bottom liquid to provide reflux for the columns and to provide an adequate up-flow of vapor through the structured packing in the lower pressure column. The reboiling of liquid oxygen is performed by heat exchange with nitrogen vapor from the top of the higher pressure column. During the heat exchange process, the nitrogen vapor is condensed, and at least some of the condensate is returned to the higher pressure column to act as a source of reflux for the higher pressure column. In some condenser-reboiler configurations, the heat exchange between the boiling liquid oxygen and the condensing nitrogen is carried out in a shell and tube heat exchanger with the liquid oxygen typically flowing within the tubes of the heat exchanger while the higher pressure column top vapor is processed on the shell side of the heat exchanger. Such shell and tube heat exchangers offer the advantage of improved operating characteristics from a safety perspective. Compactness of the shell and tube heat exchanger is achieved by having enhanced boiling and condensing surfaces, as generally described in U.S. Pat. Nos. 7,421,856; 6,393,866; and 5,699,671 and United States published patent application No. 2007/0028649.

There are two main types of heat exchangers used in the condensing-reboiling process including a thermosyphon type heat exchanger and a downflow heat type exchanger. In a thermosyphon type heat exchanger, the liquid oxygen liquid enters the tubes at the bottom and is vaporized as it passes up the tubes. In a downflow heat exchanger, the liquid oxygen liquid is vaporized as it flows downwardly within the tubes. While both of these configurations ensure safe operation of the oxygen vaporization process, both of these configurations also have certain disadvantages.

Other problems that diminish the thermal performance of the condenser-reboiler and, in turn, adversely affect the energy efficiency and operating costs of the cryogenic air separation unit are the accumulation of non-condensables in the main condenser-reboiler. The non-condensables, such as neon and helium, are present in very small quantities in air, but the accumulation of the non-condensables within a main condenser-reboiler results in a higher resistance to targeted heat transfer requiring a higher bulk temperature difference between the condensing nitrogen and boiling oxygen. As indicated above, the higher bulk temperature difference between the condensing nitrogen and boiling oxygen translates to a higher pressure requirement for the incoming nitrogen vapor which ultimately results in higher compression power and associated costs for the air separation unit. Unless the non-condensables are removed from the main condenser-reboiler cold heat exchange surfaces, the top temperature difference between the condensing nitrogen and boiling oxygen could be higher.

In addition, since the non-condensables tend to aggregate or accumulate on the heat transfer surfaces of the main condenser-reboiler where the bulk vapor velocities are lower, the high concentration zones of non-condensables in many current designs are dispersed throughout the main condenser-reboiler such that it becomes difficult to collect and remove them, which for some of the non-condensables such as neon which has significant commercial value, it cannot be recovered in a cost effective manner.

Accordingly, there is a need for an improved condensation and vaporization system which can be effectively employed to condense nitrogen vapor and vaporize liquid oxygen in a cryogenic air separation unit that does not suffer from the above-identified disadvantages.

SUMMARY OF THE INVENTION

The present invention is an improved tube and shell type condenser-reboiler system and method for use in cryogenic air separation units and adapted to use an upward flow of a condensing medium such as a nitrogen-rich vapor or air vapor within the condenser reboiler to and thereby accumulate non-condensables at the top or upper region of the condenser-reboiler. The condensing medium may be introduced to the module in most any location, including bottom, top or sides but is released into the shell proximate the lower portion or bottom of the shell to initiate the generally upward flow of the condensing medium, while the condensate flows downward and is removed near the bottom of the shell.

Specifically, the present invention may be characterized as a condensation and vaporization system for a distillation column based air separation unit comprising: (i) one or more condenser-reboiler modules having a housing defining a top, a bottom, one or more lateral sides, an upper portion, and a lower portion, the one or more condenser-reboiler modules disposed between a lower pressure column and a higher pressure column and configured to receive a condensing medium at a condensing inlet, an oxygen-rich liquid from the lower pressure column at an oxygen-rich liquid inlet, and further defining a condensate outlet proximate the bottom and an oxygen-rich effluent outlet; (ii) a heat exchanger disposed in the one or more condenser-reboiler modules, the heat exchanger configured to partially vaporize the oxygen-rich liquid forming an oxygen-rich effluent and condense the condensing medium forming a condensate; and (iii) one or more vents disposed on the periphery of the one or more condenser-reboiler modules and configured to remove the accumulated non-condensables from within the one or more condenser-reboiler modules. In the present system, the condensing medium is released within the heat exchanger in the condenser-reboiler modules proximate the bottom of the housing and flows in an upward and radial outward direction within the one or more condenser-reboiler modules and non-condensables present in the condensing medium accumulate proximate the upper portion or top of the one or more condenser-reboiler modules.

The heat exchanger may be a shell and tube heat exchanger comprising two opposed tube sheets, a cylindrical shell connecting the two opposed tube sheets, and a plurality of tubes extending therebetween for indirectly exchanging heat between the oxygen-rich liquid flowing within the plurality of tubes and the condensing medium flowing upward within the cylindrical shell. The heat exchanger may be a thermosyphon type heat exchanger with the oxygen-rich liquid inlet disposed proximate the bottom of the condenser-reboiler module and the oxygen-rich effluent outlet is disposed near the top.

Alternatively, the heat exchanger may be a downflow type heat exchanger where the oxygen-rich liquid inlet is disposed proximate the top of the condenser-reboiler module and the oxygen-rich effluent outlet is disposed proximate the bottom of the condenser-reboiler module. In the case of a downflow type heat exchanger, the oxygen-rich liquid may be pumped from the bottom of the lower pressure column to the top or upper portion of the condenser-reboiler module for re-boiling or the oxygen-rich liquid may be collected from the descending liquid in the lower pressure column using a collector disposed above the top of the condenser-reboiler module where it can be supplied to the top or upper portion of the condenser-reboiler module for re-boiling.

The condenser-reboiler module may be configured in a variety of arrangements including one embodiment where the condensate outlet is disposed proximate the bottom of the condenser-reboiler module and concentrically around the condensing medium or nitrogen-rich vapor inlet. Another embodiment provides the condensate outlet proximate the bottom of the condenser-reboiler module but near the lateral side or peripheral edges of the housing. Still further, multiple condensate outlets may be provided including a centrally disposed and a peripherally disposed outlet.

Still other embodiments of the present condenser-reboiler contemplate providing an impingement plate or baffle plates centrally disposed in a lower portion or upper portion of the condenser-reboiler module. The impingement plate or baffle plates are configured to radially deflect the upward flow of the condensing medium (e.g. nitrogen-rich vapor or air vapor) to enhance the dispersion of the condensing medium to the condensing surfaces and also minimize possible bypass flow through axial direction. Alternatively, some embodiments of the condenser-reboiler modules may include a distributor structure centrally disposed in a lower portion of the condenser-reboiler module and configured to radially distribute the flow of the condensing medium to disperse the nitrogen-rich vapor to the condensing surfaces. The condensing medium inlet may be disposed at the top or the lateral sides of the condenser-reboiler module and directed via a conduit to the perforated distributor structure where the upward flow of the nitrogen-rich vapor is initiated. Alternatively, the condensing medium inlet may be disposed at the bottom of the condenser-reboiler module where the upward and radially outward flow of the condensing medium is initiated as soon as it enters the housing or shell.

The present invention may also be characterized as a method for carrying out cryogenic air separation comprising the steps of: (a) separating feed air within a higher pressure column by cryogenic rectification to produce nitrogen-rich vapor and oxygen enriched fluid, passing oxygen enriched fluid from the higher pressure column into a lower pressure column, and producing by cryogenic rectification an oxygen-rich liquid within the lower pressure column; (b) directing the oxygen-rich liquid and a condensing medium to one or more condenser-reboiler modules having a plurality of vertically oriented tubes; (c) partially vaporizing the oxygen-rich liquid through the plurality of vertically oriented tubes in the one or more condenser-reboiler modules; (d) releasing the condensing medium into the central portion of the one or more condenser-reboiler modules so as to flow in a radially outward direction through the one or more condenser-reboiler modules and in contact with condensing surfaces of the vertically oriented tubes to condense the condensing medium by indirect heat exchange with the partially vaporizing oxygen-rich liquid and produce a condensate and an oxygen-rich effluent wherein non-condensables present in the condensing medium accumulate proximate an upper portion or top of the one or more condenser-reboiler modules; and (e) removing the accumulated non-condensables from within the one or more condenser-reboiler modules via a plurality of perforated vent tubes disposed on the periphery of the condenser modules.

In preferred embodiments of the above-described system and method, the one or more vents further comprise a plurality of perforated tubes disposed on the periphery of the housing and extending vertically along all or a portion of the lateral sides thereof. Specifically, each of the perforated tubes further comprise a tubular shaped body defining an open end, an outer surface and an interior space and having a plurality of apertures or holes from the outer surface to the interior space. The perforated tubes are configured to be in contact with the condensing medium such that non-condensables in the condensing medium are conveyed through the holes into the interior space and vented from the condenser-reboiler modules via the open end. Preferably, the open end of the perforated tubes extends through the housing at a location proximate the upper portion or top of the housing. The apertures or holes are preferably disposed on the uppermost portion of the tubular body toward the open end and further disposed around the entire periphery of the outer surface while being spaced vertically apart on the tubular body.

Finally, the present invention may alternatively be characterized as a vent apparatus configured for use in a condenser such as a main condenser-reboiler of an air separation plant. The present vent apparatus comprises: (i) a plurality of perforated tubes each having a tubular shaped body defining an open end, an outer surface and an interior space and having a plurality of apertures or holes from the outer surface to the interior space; and (ii) a vent manifold fluidically coupling the open ends of the plurality of perforated tubes. The perforated tubes are preferably disposed on the inner periphery of a condenser housing and extending vertically along all or a portion of thereof and in contact with a condensing medium within the condenser housing such that non-condensables in the condensing medium are conveyed through the holes into the interior space and vented from the condenser-reboiler modules via the open end. Preferably, the open end of the perforated tubes extends through the condenser housing at a location proximate the upper portion or top of the condenser housing. The apertures or holes are preferably disposed on the uppermost portion of the tubular body toward the open end and further disposed around the entire periphery of the outer surface of the tubular shaped body while being spaced vertically apart. In some applications, the vent apparatus may include a non-condensable recovery system coupled to the vent manifold and configured to purify and/or recover the non-condensables collected from the plurality of perforated tubes.

BRIEF DESCRIPTION OF THE DRAWINGS

While the specification concludes with claims distinctly pointing out the subject matter that applicants regard as their invention, it is believed that the invention will be better understood when taken in connection with the accompanying drawings in which:

For the sake of avoiding repetition, some of the common elements in the various Figures utilize the same numbers where the explanation of such elements would not change from Figure to Figure.

DETAILED DESCRIPTION

Figure 2:
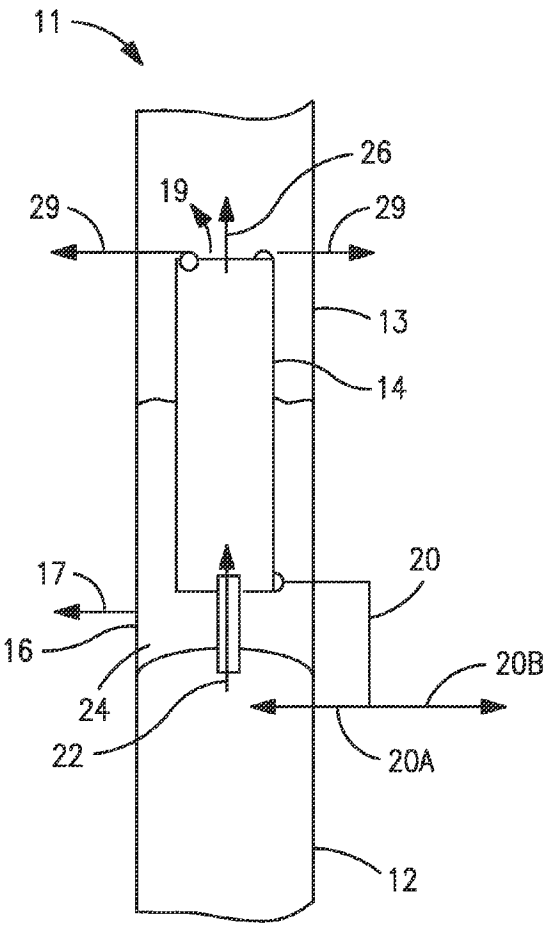
FIG. 2 is another schematic illustration of a distillation column arrangement in an air separation unit depicting condenser-reboiler in a thermosyphon type arrangement for boiling of a liquid oxygen stream and up-flow of the nitrogen vapor in accordance with an alternate embodiment of the present invention.
Figure 1:
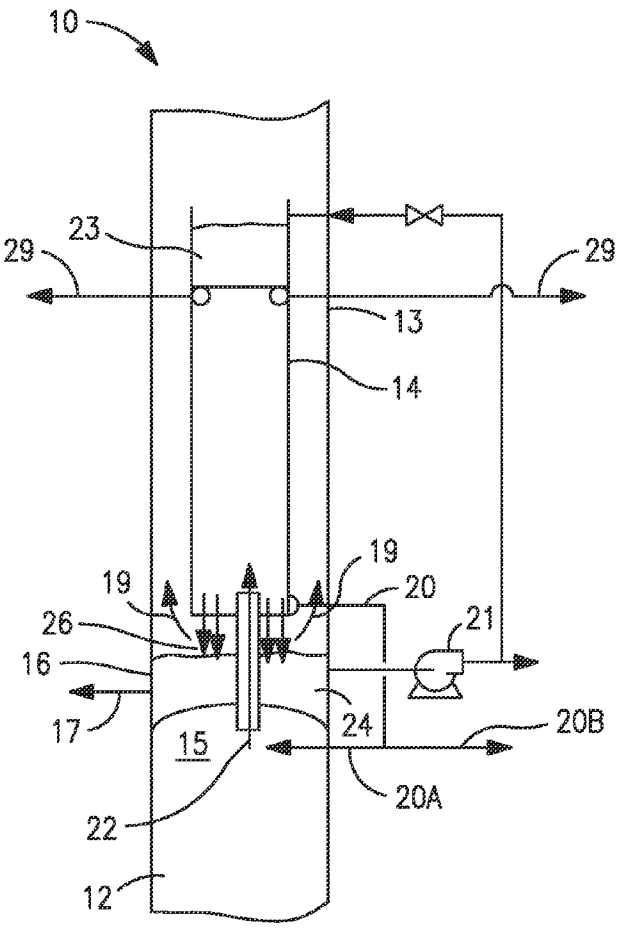
FIG. 1 is a schematic illustration of a distillation column arrangement in an air separation unit depicting the condenser-reboiler in a downflow type arrangement for boiling of a liquid oxygen stream and up-flow of the nitrogen vapor in accordance with an embodiment of the present invention.
Figure 4:
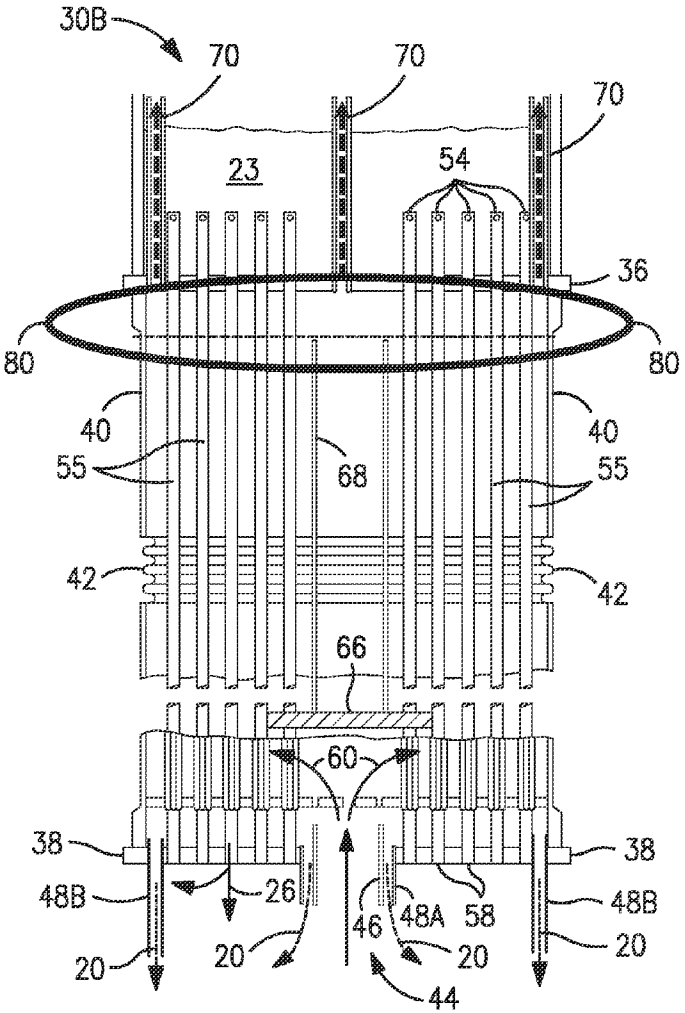
FIG. 4 is an elevational sectional view of yet another embodiment of the condenser-reboiler module with a downflow type arrangement for boiling of a liquid oxygen stream and up-flow of the nitrogen-rich vapor.
Figure 3:
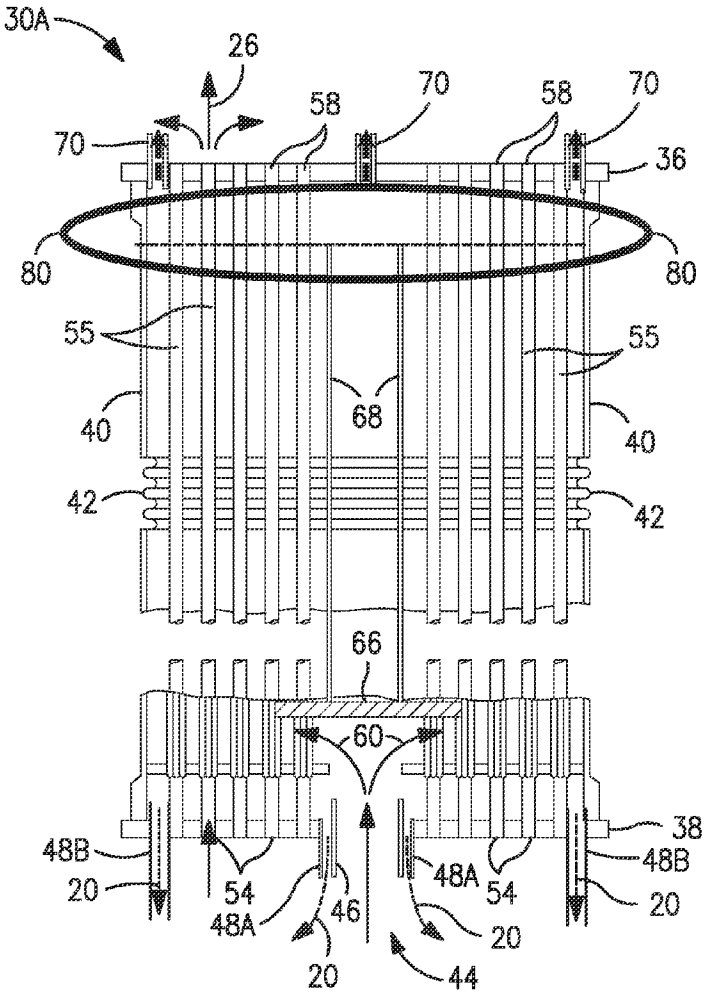
FIG. 3 is an elevational sectional view of yet another embodiment of the condenser-reboiler module with a thermosyphon type arrangement for boiling of a liquid oxygen stream and up-flow of the nitrogen-rich vapor.

Turning now to FIG. 1 and FIG. 2, there is shown a schematic illustration of a distillation column arrangement in an air separation unit depicting a typical condenser-reboiler module with up-flow of the condensing medium such as nitrogen vapor or air vapor. FIG. 1 shows the present condenser-reboiler with up-flow of the nitrogen vapor configured as a downflow type heat exchanger whereas FIG. 2 shows the present condenser-reboiler with up-flow of the nitrogen vapor configured as a thermosyphon type heat exchanger.

The distillation column arrangements 10 and 11 each have a higher pressure distillation column 12 and a lower pressure distillation column 13 and a main condenser-reboiler module 14 coupling the higher and lower pressure distillation columns in a heat transfer relationship. The distillation column arrangements 10 and 11 are specifically designed to conduct a distillation process in connection. Distillation column arrangements 10 and 11 are used in the separation to produce nitrogen and oxygen enriched products. Although not illustrated, as also well known, in an air separation unit (ASU), incoming air is compressed, purified and cooled to a temperature suitable for its rectification. The purified and cooled air is then introduced into the higher pressure distillation column 12 where an ascending vapor phase is contacted with the descending liquid phase by known mass transfer contacting elements which can be structured packing, random packing or sieve trays or a combination of such packing and trays. The ascending vapor phase of the air becomes rich in nitrogen as it ascends and a descending liquid phase becomes rich in oxygen. As a result, a bottoms liquid known as crude liquid oxygen or kettle liquid collects in the bottom of the higher pressure column 12 and a nitrogen-rich vapor 15 collects in the top or upper portion of the higher pressure column 12.

A stream of the nitrogen-rich vapor 22 is introduced into an inlet conduit 24 that is coupled to the condenser-reboiler module 14 near the bottom. Alternatively, the nitrogen rich stream may be introduced to the condenser-reboiler module near the top or side of the module and released within the shell at or near the bottom of the shell. As will be discussed in more detail below, the nitrogen-rich vapor 22 released within the shell flows in a generally upward direction within the condenser-reboiler shell and indirectly exchanges heat with the oxygen-rich liquid in the condenser-reboiler tubes to partially vaporize the oxygen liquid and to condense the nitrogen-rich vapor 22. In the embodiment of FIG. 1, the oxygen-rich liquid taken from the column bottoms 16 may be circulated via pump 21 from the bottom of the lower pressure column to the top or uppermost portion of the condenser-reboiler module 14 where it is collected as 23 and descends within the condenser-reboiler tubes in a downflow type heat exchanger arrangement. Vaporization of the oxygen-rich liquid produces a two phase oxygen-rich effluent stream 26 that exits proximate the bottom of the condenser-reboiler module 14. The stream may be extracted as oxygen product or may become part of the ascending vapor phase 19 within lower pressure distillation column 13. Any oxygen liquid that is not vaporized returns to the bottom of the lower pressure distillation column 13 and the oxygen-rich liquid column bottoms 16.

Alternatively, in the embodiment of FIG. 2, the oxygen-rich liquid taken from the column bottom 16 may ascend within the condenser-reboiler tubes by the thermosyphon effect, discussed above. The vaporization of the oxygen-rich liquid produces an oxygen-rich effluent stream 26 that forms part of the ascending vapor phase 19 within lower pressure distillation column 13 as the partially vaporized oxygen-rich effluent stream 26 exits the condenser-reboiler module 14. Any oxygen liquid that is not vaporized may return to the bottom of the lower pressure distillation column 13 and the oxygen liquid column bottoms 16.

In both embodiments shown in FIG. 1 and FIG. 2, the resulting condensate 20 that consists of nitrogen-rich liquid is discharged from the bottom of the condenser-reboiler module 14. A first portion of the condensate 20A is coupled to the higher pressure column 12 to be used as a reflux stream comprised of the nitrogen-rich liquid. A part of the second portion of the condensate 20B is coupled to the lower pressure column 13 while another part of such stream 20B could be taken as a liquid product or pumped and heated, taken as a pressurized product. Preferably, a liquid distributor (not shown) is provided within the top portion of the higher pressure column 12 and the top portion of the lower pressure column 13 to collect the nitrogen-rich reflux, 20A and 20B respectively, and distribute the reflux streams to mass transfer contacting elements.

The advantages provided by the above-described embodiments relate to lower operating costs that may be realized as a result of improvements in thermal efficiency of the main condenser which translates to power savings as well as potential capital savings during the construction of an air separation unit. The improvements in thermal efficiencies may be achieved through the enhanced separation and removal of accumulated non-condensables such as neon and helium by discharging vent streams 29 from the condenser-reboiler 14.

Neon and helium are present in very small quantities in air, roughly 18 ppm for neon and about 5 ppm for helium. These non-condensables tend to concentrate at much higher levels in the main condenser of an air separation unit as the nitrogen-rich vapor condenses and is removed to form the reflux streams. These concentrated non-condensables also tend to accumulate or aggregate at or near the cold heat transfer surfaces particularly in regions or locations within the condenser-reboiler modules away from the nitrogen-rich vapor inlet where the bulk nitrogen-rich vapor velocities are lower. Accumulation or aggregation of the non-condensables may result in a higher resistance to heat transfer occurring within the condenser-reboiler modules which in turn requires a higher bulk temperature difference between the condensing nitrogen and boiling oxygen. The higher bulk temperature difference drives the need for increased pressure of the higher pressure column from which the nitrogen-rich vapor originates which ultimately results in higher compression power for the air separation unit.

In the above-described embodiments, the nitrogen-rich vapor is introduced via an inlet that causes the flow of the nitrogen-rich vapor in a generally upward and somewhat radial direction through the condenser-reboiler modules. Using this upward and radial flow arrangement and against gravity, non-condensables such as neon and helium that are present in the nitrogen-rich vapor will tend to accumulate near the top or uppermost portion of the condenser-reboiler modules (See region 80 in FIGS. 3-16). During the condensation, the vapor continues to flow upward whereas the condensate flows in the opposite direction which permits an increasing vapor non-condensable concentration gradient which should lead to increased separation and higher condensation heat transfer. In addition, in the embodiments where the nitrogen-rich vapor from top of the higher pressure column is fed straight into the lower portion or bottom of the main condenser-reboiler, the pressure drop could be reduced compared to prior art designs.

Also, by accumulating the non-condensables near the top or uppermost portion of the condenser-reboiler modules, they are more easily collected and removed by venting the non-condensables resulting in enhanced performance of condenser-reboiler modules. Equally important is that easy collection and removal of the non-condensables, such as neon and helium facilitates the separation, purification and recovery of selected high value gases, such as neon.

As described in more detail below, venting of the non-condensables is achieved by providing one or more vents and associated vent control valves (not shown) disposed proximate the top of the condenser-reboiler modules where the non-condensables are accumulating or aggregating. Through control of the vent control valves, the accumulated non-condensables are purged or removed from the condenser-reboiler module. Preferably, the vents are centrally disposed at the top of the condenser-reboiler module or at the top of the condenser-reboiler module proximate the lateral side or peripheral edge. It may also be advantageous to place multiple vent locations on each condenser-reboiler module, including both centrally disposed and peripherally disposed vents.

Unlike many prior art designs, which separates the location of the nitrogen-rich vapor feed manifold and the liquid nitrogen condensate manifold, the present system allows for the feed and condensate manifolds to be co-located. Co-locating the nitrogen-rich vapor feed to the condenser-reboiler modules with the liquid nitrogen condensate collection point at or below the bottom of the condenser-reboiler modules results in a reduction the net manifolding volume associated with the main condenser and increases the overall thermal performance of the condenser-reboiler modules. Reducing the net manifolding volume and co-locating the nitrogen-rich vapor feed manifold with the liquid nitrogen condensate manifold below the bottom of each condenser-reboiler module allows for the reduction in column height and associated capital expense.

In many of the prior art condenser-reboiler designs, a plurality of condenser-reboiler modules are often fed by a single internal or external nitrogen-rich vapor pipe which moves the nitrogen-rich vapor from the upper portion of the higher pressure column to a point above the condenser-reboiler modules. The transported nitrogen-rich vapor flow is then split and fed into the top of each condenser-reboiler module where it flows in a downward orientation contacting the condensing surfaces. Liquid nitrogen condensate is collected at the bottom of each condenser-reboiler module before being combined into a single condensate manifold or pipe. Regardless of the routing, the nitrogen-rich vapor feed manifold in most of the current condenser-reboiler designs takes up significant space above the assembly, which increases column height, complexity and expense.

Turning now to FIGS. 3, 4, 11, 12, 13, 14, 15, 16, there is shown various embodiments of the present condenser-reboiler module 14. In all illustrated embodiments, the condenser-reboiler module 14 includes a shell and tube heat exchanger 30A, 30B that is provided with two opposed tube sheets 36 and 38. A cylindrical shell 40 connects the tube sheets 36 and 38. A bellows-like expansion joint 42 can be provided for purposes of differential expansion. A plurality of vertically oriented condensing tubes extending between the two opposed tube sheets are arranged for indirectly exchanging heat between the oxygen-rich liquid flowing within the plurality of tubes and the condensing medium, such as a nitrogen-rich vapor or air vapor, flowing upward within the cylindrical shell 40. Tube sheet 38 is provided with a central nitrogen-rich vapor or condensing medium inlet 44 to allow the condensing medium to enter the shell 40. An inlet pipe 46 can be connected to the tube sheet 38 to facilitate flow of the condensing medium through with the central condensing medium inlet 44 into the interior spaces of the shell 40. Although not shown, inlet pipe 46 is also connected to the upper portion of the higher pressure column where the supply of the condensing medium, and more particularly, nitrogen-rich vapor is found.

Figure 12:
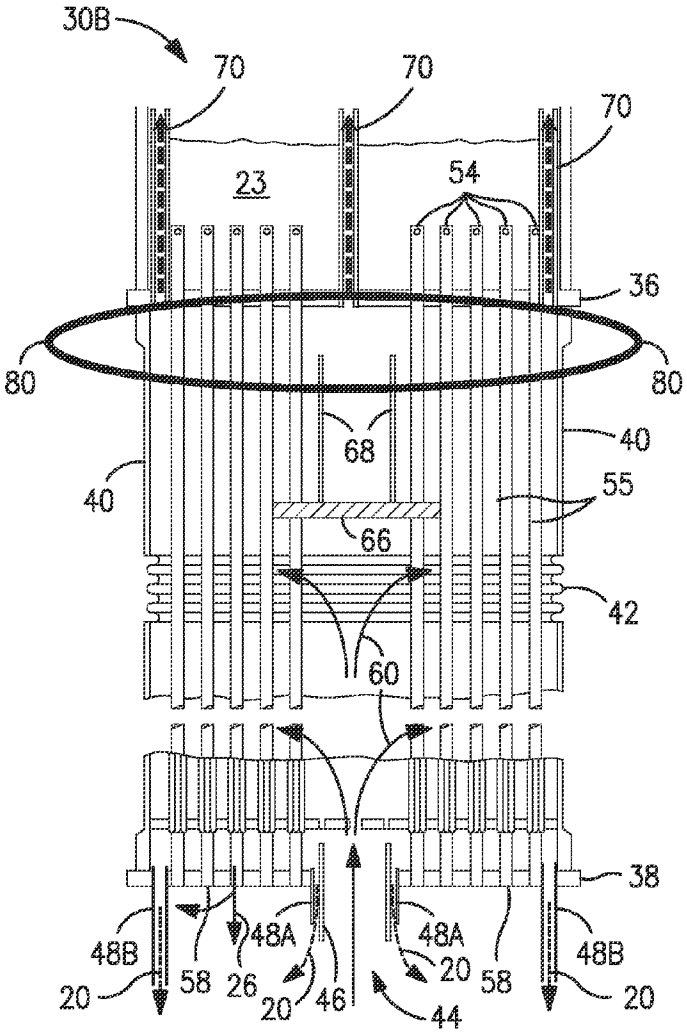
FIG. 12 is an elevational sectional view of another embodiment of the condenser-reboiler module with a downflow type arrangement for boiling of a liquid oxygen stream and up-flow of the nitrogen vapor.
Figure 14:
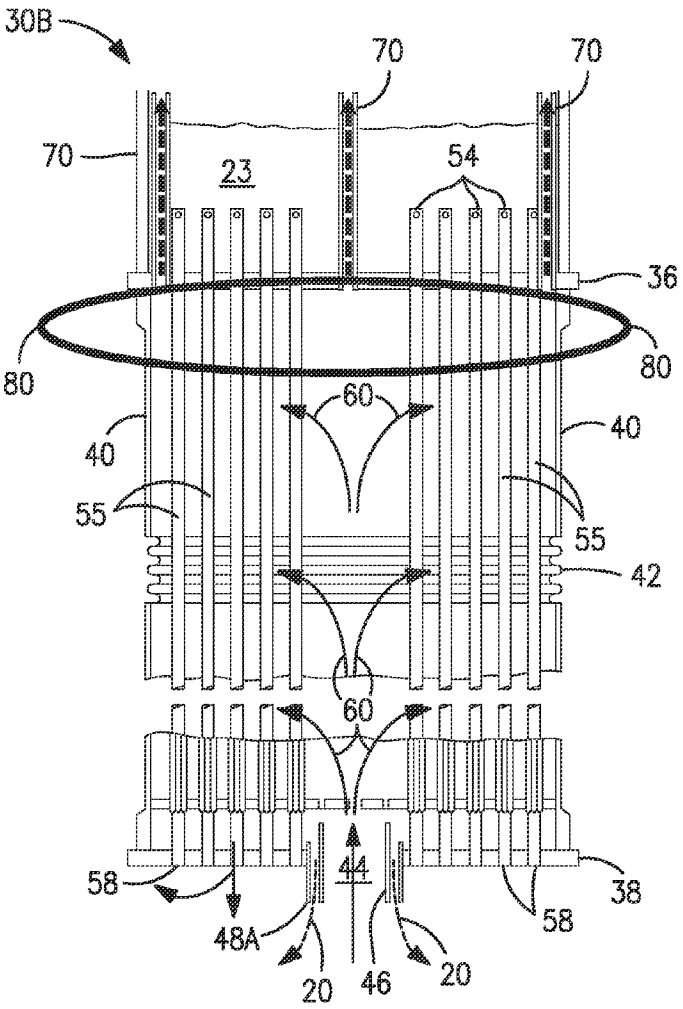
FIG. 14 is an elevational sectional view of an embodiment of condenser-reboiler module with a downflow type arrangement for boiling of a liquid oxygen stream and up-flow of the nitrogen vapor in accordance with the present invention.
Figure 13:
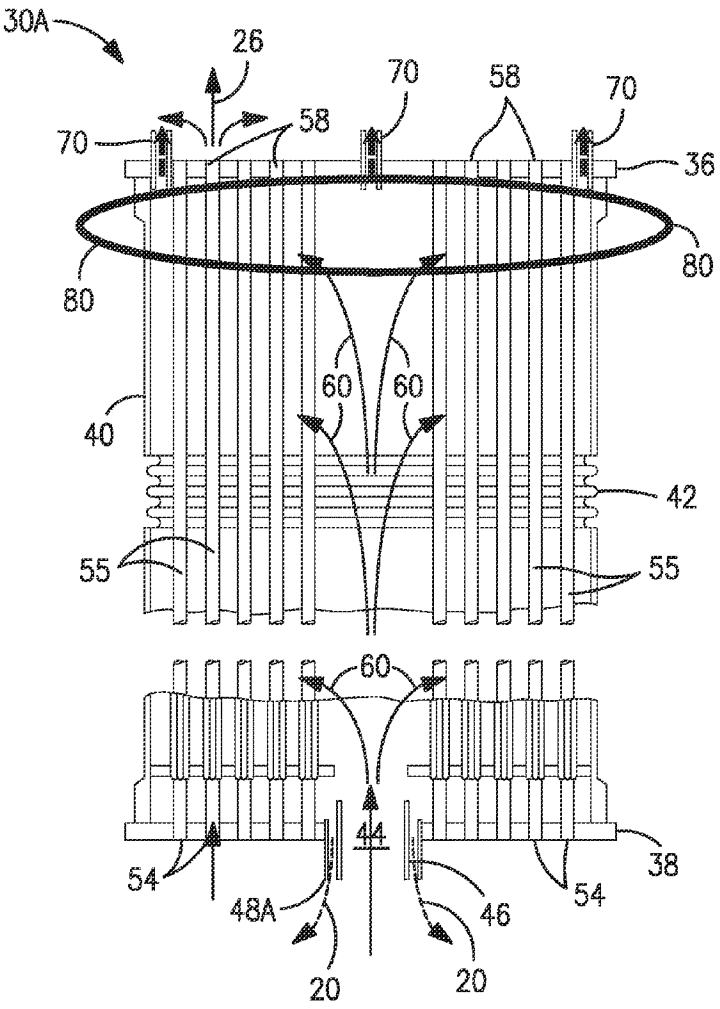
FIG. 13 is an elevational sectional view of an embodiment of condenser-reboiler module with a thermosyphon type arrangement for boiling of a liquid oxygen stream and up-flow of the nitrogen vapor in accordance with the present invention.
Figure 16:
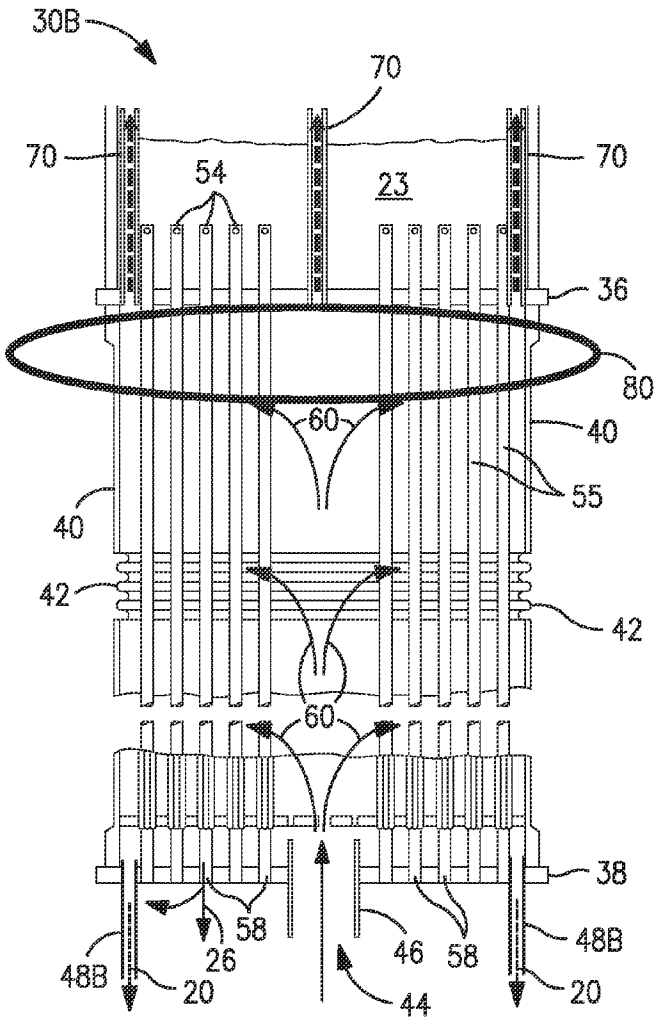
FIG. 16 is an elevational sectional view of an alternate embodiment of the condenser-reboiler module with a downflow type arrangement for boiling of a liquid oxygen stream and up-flow of the nitrogen vapor.
Figure 15:
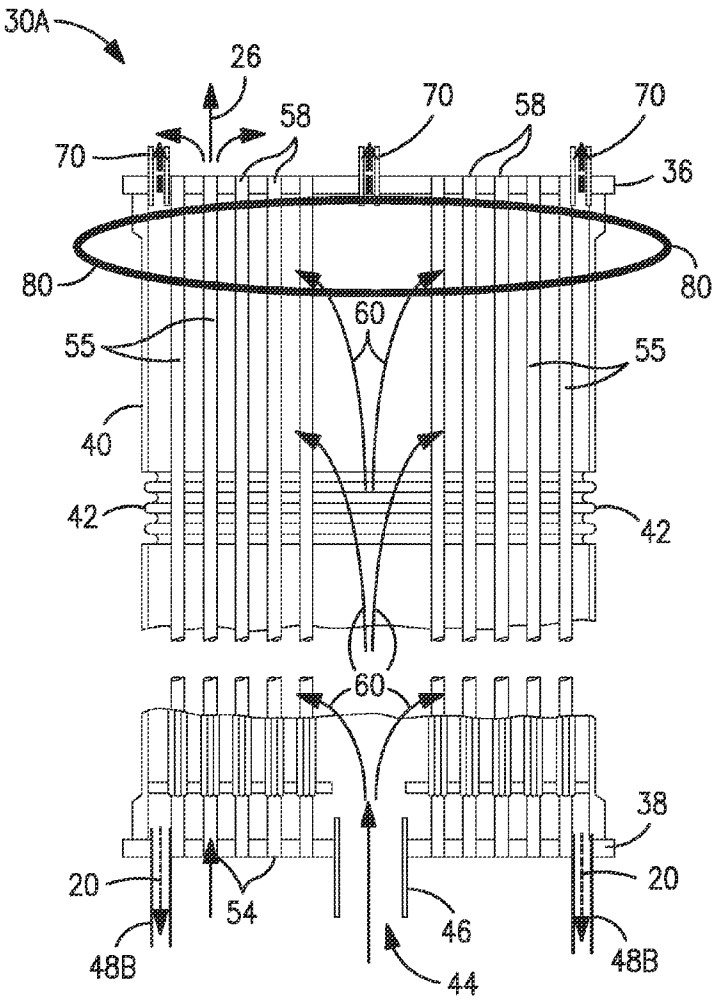
FIG. 15 is an elevational sectional view of an alternate embodiment of the condenser-reboiler module with a thermosyphon type arrangement for boiling of a liquid oxygen stream and up-flow of the nitrogen vapor.

A condensate outlet 48 is provided in the tube sheet 38 for discharging the condensate 20 produced by condensing the nitrogen-rich vapor and thereby forming the nitrogen-rich liquid to be used as reflux streams 20A, 20B for the higher pressure column and lower pressure column, respectively. Additionally, such stream 20B could be taken as a liquid product or pumped and heated, and taken as a pressurized product. In FIG. 13 and FIG. 14, the condensate outlet 48 is centrally disposed at the bottom of the condenser-reboiler module concentrically with respect to the condensing medium inlet 44. In FIG. 15 and FIG. 16, the condensate outlet 48 is disposed at the bottom of the condenser-reboiler module 14 but closer to the edge or periphery of the condenser-reboiler module 14. FIGS. 3, 4, 11, and 12 show embodiments with multiple condensate outlets 48, including a centrally disposed condensate outlet 48A and peripherally disposed condensate outlet 48B both located at or near the bottom of condenser-reboiler module 14.

FIGS. 3, 5, 7, 9, 11, 13 and 15 show a thermosyphon type heat exchanger 30A where the oxygen-rich liquid inlets 54 are associated with each of the vertically oriented condensing tubes 55 and disposed proximate the bottom of the condenser-reboiler module 14. Similarly, the oxygen-rich effluent outlets 58 are associated with each of the vertically oriented condensing tubes 55 and disposed proximate the top of the condenser-reboiler module 14. In these embodiments, the oxygen-rich liquid at the bottom of the lower pressure column is supplied to the oxygen-rich liquid inlets 54 for re-boiling within the heat exchanger 30A.

FIGS. 4, 6, 8, 10, 12, 14 and 16 show a downflow type heat exchanger 30B where the oxygen-rich liquid inlets 54 are disposed at one end of the vertically oriented tubes 55 proximate the top of the condenser-reboiler module 14 and tubesheet 36 whereas the oxygen-rich effluent outlet 58 is disposed the other end of the condensing tubes 55 at or near the bottom of the condenser-reboiler module 14 and tubesheet 38. In these embodiments, the oxygen-rich liquid at the bottom of the lower pressure column is supplied to the oxygen-rich liquid inlets 54 for re-boiling within the heat exchanger 30B.

Figure 11:
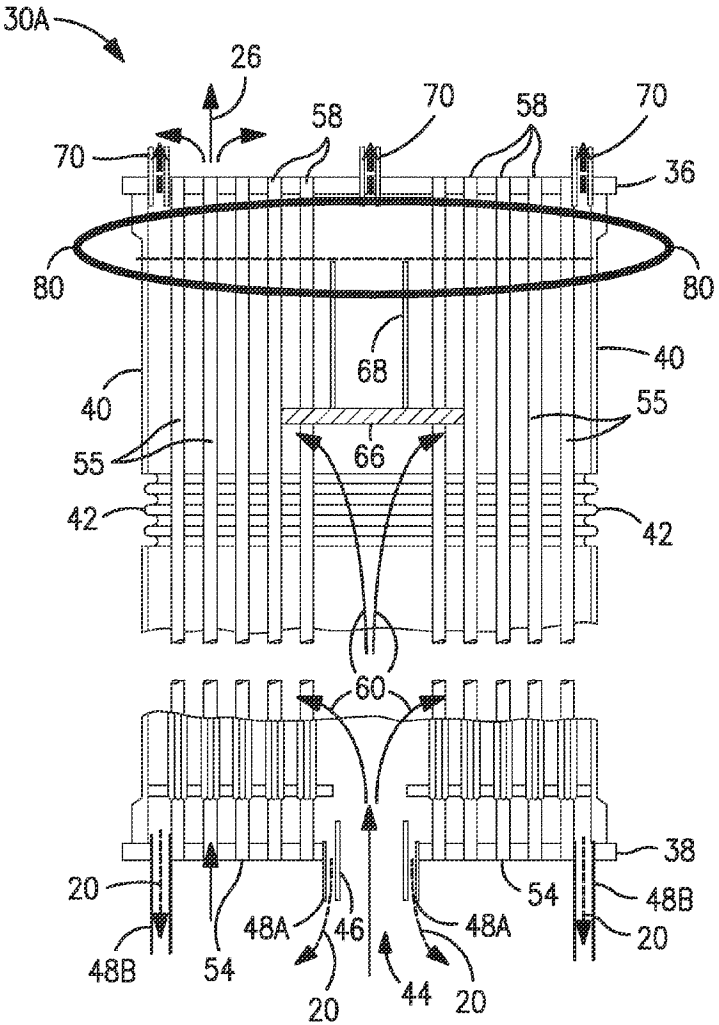
FIG. 11 is an elevational sectional view of another embodiment of condenser-reboiler module with a thermosyphon type arrangement for boiling of a liquid oxygen stream and up-flow of the nitrogen vapor.

In all the illustrated embodiments, the condensing tubes 55 are preferably all of the same design and diameter. It is to be noted that all of the condensing tubes 55 could be provided with an outer fluted surface and the interior of the tubes could be provided with an enhanced boiling surfaces. A condensing medium such as nitrogen-rich vapor enters each of the condenser-reboiler modules 14 through the central condensing medium inlet 44 and then flows in an upward and radially outward direction as suggested by arrows 60. As seen in FIGS. 3, 4, 11, and 12, the condenser-reboiler modules 14 may also include a centrally disposed impingement plate 66 that will also have an effect of urging the incoming condensing medium or nitrogen-rich vapor flow in the outward radial direction. The impingement plate 66 is connected to the tubesheet 36 or to the vertically oriented tubes 55 by means of a set of supports 68. In FIGS. 11 and 12, the impingement plate is located in an upper portion of the heat exchanger 30A, 30B whereas in FIGS. 3 and 4, the impingement plate is located in a lower portion of the of the heat exchanger 30A, 30B and within the shell 40. Either way, the impingement plate 66 is configured to deflect the upward flow of the condensing medium (e.g. nitrogen-rich vapor or air vapor) and radially disperse the condensing medium to the condensing surfaces within the shell 40, namely the exterior surfaces of the tubes 55.

Figure 6:
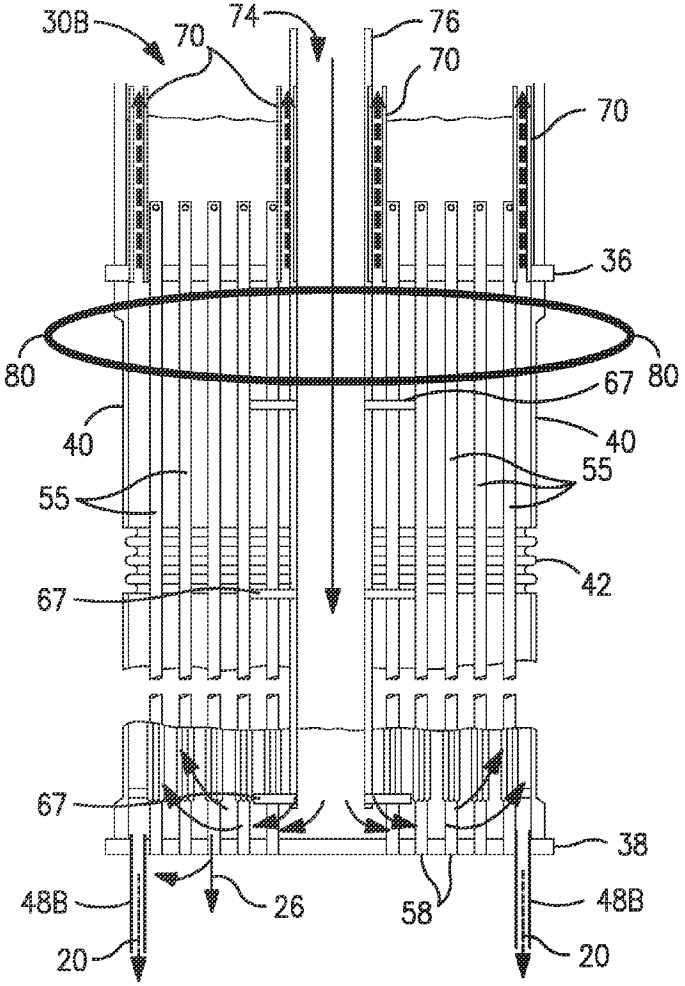
FIG. 6 is an elevational sectional view of yet another embodiment of the condenser-reboiler module with a downflow type arrangement for boiling of a liquid oxygen stream and generally upward flow distribution of the nitrogen-rich vapor.
Figure 5:
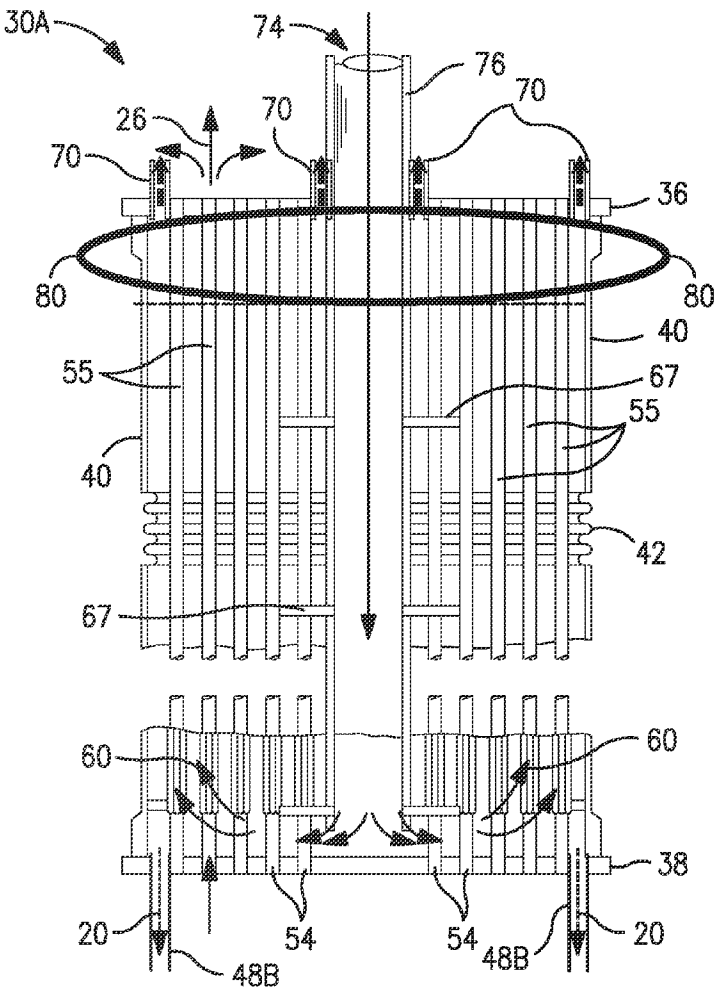
FIG. 5 is an elevational sectional view of yet another embodiment of the condenser-reboiler module with a thermosyphon type arrangement for boiling of a liquid oxygen stream and generally upward flow distribution of the nitrogen-rich vapor.
Figure 8:
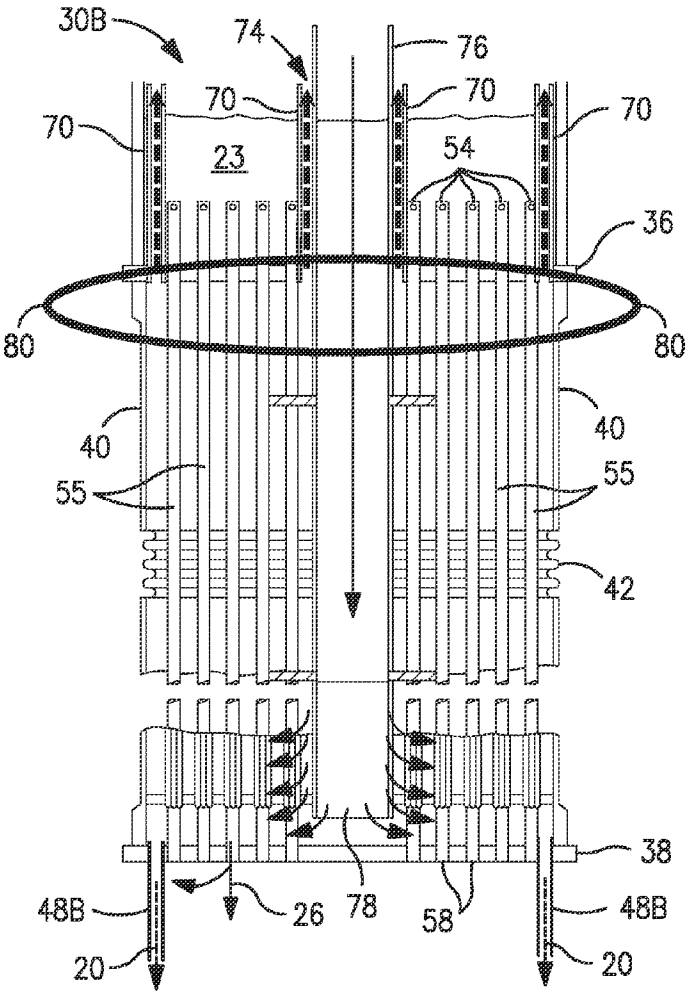
FIG. 8 is an elevational sectional view of yet another embodiment of the condenser-reboiler module with a downflow type arrangement for boiling of a liquid oxygen stream and generally upward flow distribution of the nitrogen-rich vapor with perforated distributor.
Figure 7:
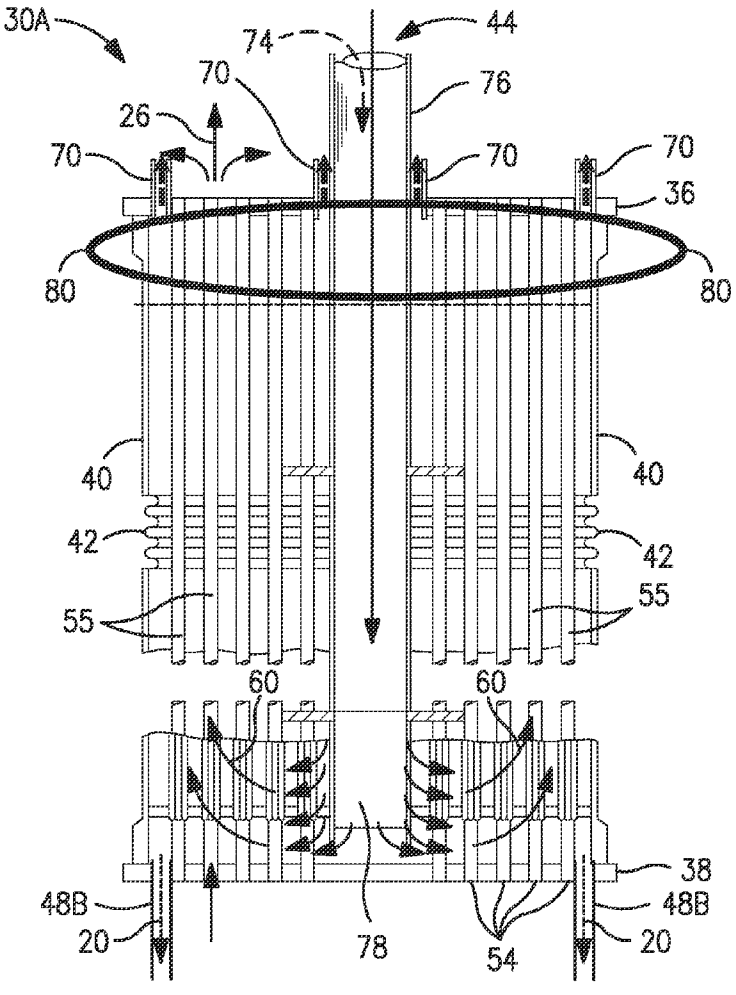
FIG. 7 is an elevational sectional view of yet another embodiment of the condenser-reboiler module with a thermosyphon type arrangement for boiling of a liquid oxygen stream and generally upward flow distribution of the nitrogen-rich vapor with perforated distributor.

Turning now to FIG. 5 and FIG. 6, there is shown yet another embodiment of the thermosyphon type heat exchanger 30A and downflow type heat exchanger 30B, respectively. These two embodiments differ from the previously discussed embodiments in that the condensing medium inlet 74 is not located at or near the bottom of the condenser-reboiler module 14 and tubesheet 38 but rather at or near the top of the condenser-reboiler module 14 and tubesheet 36. Although not shown, alternative embodiments also contemplate locating the condensing medium inlet at or near the side or periphery of the shell 40. The condensing medium, preferably nitrogen-rich vapor, is directed from the upper portion of the higher pressure column via inlet conduit 76 within the shell 40 towards the lower portion of the heat exchanger 30A, 30B. At the end of the inlet conduit 76 the flow of condensing medium or nitrogen-rich vapor is released and is radially dispersed within the shell 40. For further improvement of flow distribution of condensing vapor, the perforated structures can be used at the bottom of inlet conduit 76 in FIG. 7 and FIG. 8. Upon dispersion, the condensing medium will flow in the generally upward and radially outward direction to the condensing surfaces.

Figure 10:
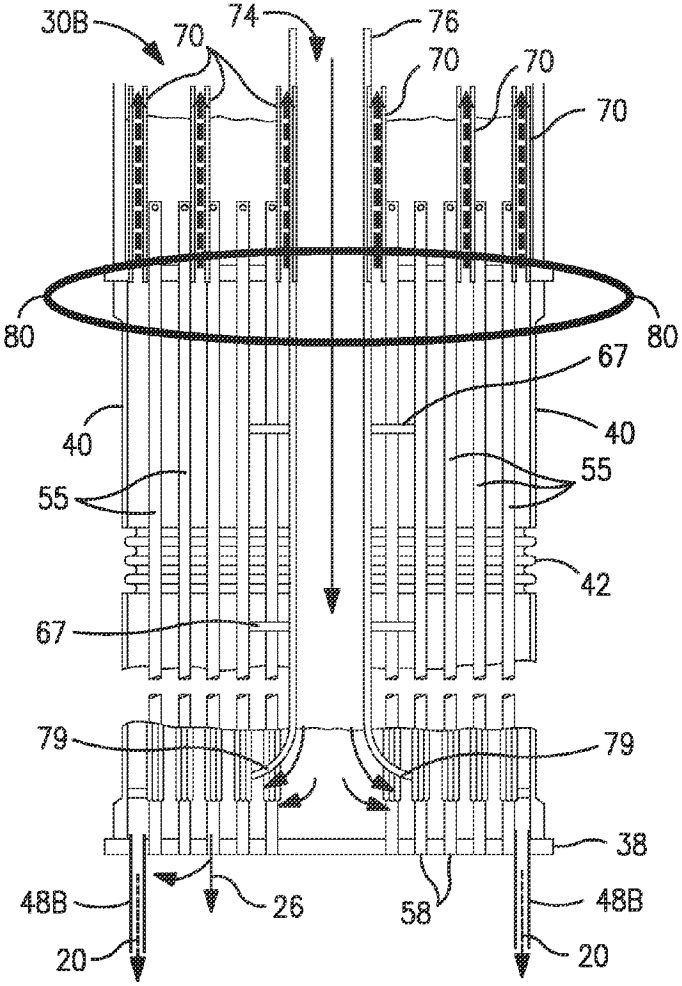
FIG. 10 is an elevational sectional view of still yet another embodiment of the condenser-reboiler module with a downflow type arrangement for boiling of a liquid oxygen stream and generally upward flow distribution of the nitrogen-rich vapor.
Figure 9:
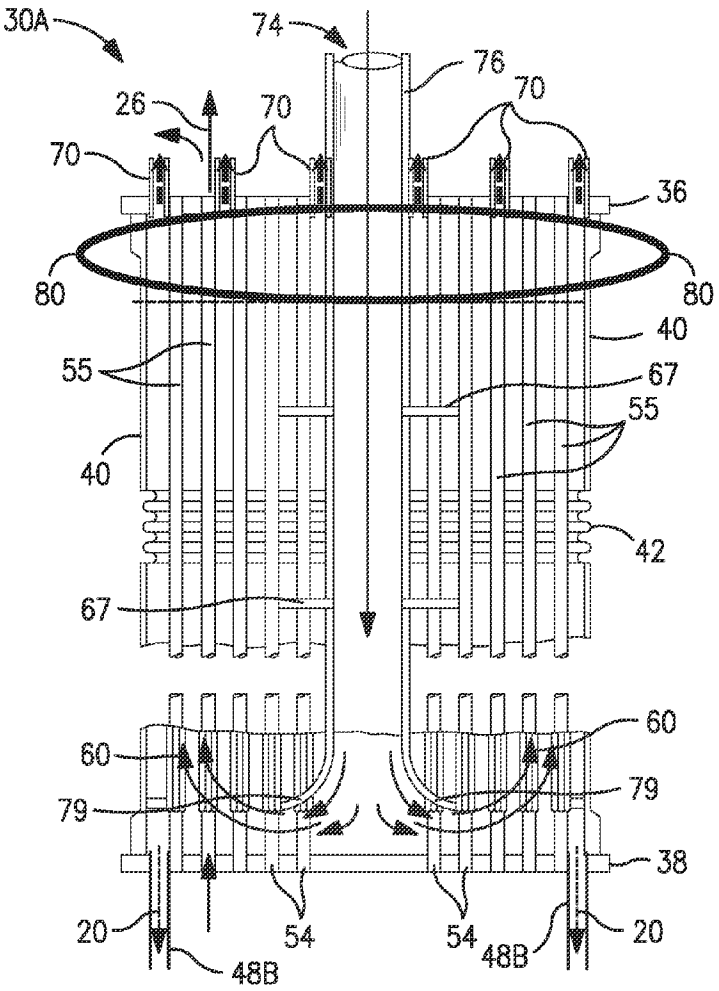
FIG. 9 is an elevational sectional view of still yet another embodiment of the condenser-reboiler module with a thermosyphon type arrangement for boiling of a liquid oxygen stream and generally upward flow distribution of the nitrogen-rich vapor.

In FIG. 9 and FIG. 10, there is shown yet another embodiment of the thermosyphon type heat exchanger 30A and downflow type heat exchanger 30B, respectively. As with the embodiments of FIGS. 5-8, the condensing medium inlet 74 is not located at or near the bottom of the condenser-reboiler module 14 and tubesheet 38 but rather at or near the side or the top of the condenser-reboiler module 14 and tubesheet 36. The condensing medium is preferably a nitrogen rich vapor that is directed from the upper portion of the higher pressure column via inlet conduit 76 within the shell 40 towards the lower portion of the heat exchanger 30A, 30B. At the end of the inlet conduit 76 there is a diffuser-like distributor structure 79 configured to radially distribute the flow of the nitrogen-rich vapor and diffuse the nitrogen-rich vapor flow proximate the lower portion of the shell 40. Upon release from the conduit 76, the nitrogen-rich vapor will flow in the generally upward and radially outward direction towards the condensing surfaces. One or more baffle plates 67 are shown centrally disposed within the shell 40 to deflect or urge the resulting upward flow of released nitrogen rich vapor within the shell 40 in an outward radial direction away from the conduit 76. The baffle plates 67 also serve as a central support member for the innermost array of condensing tubes 55.

Figure 17:
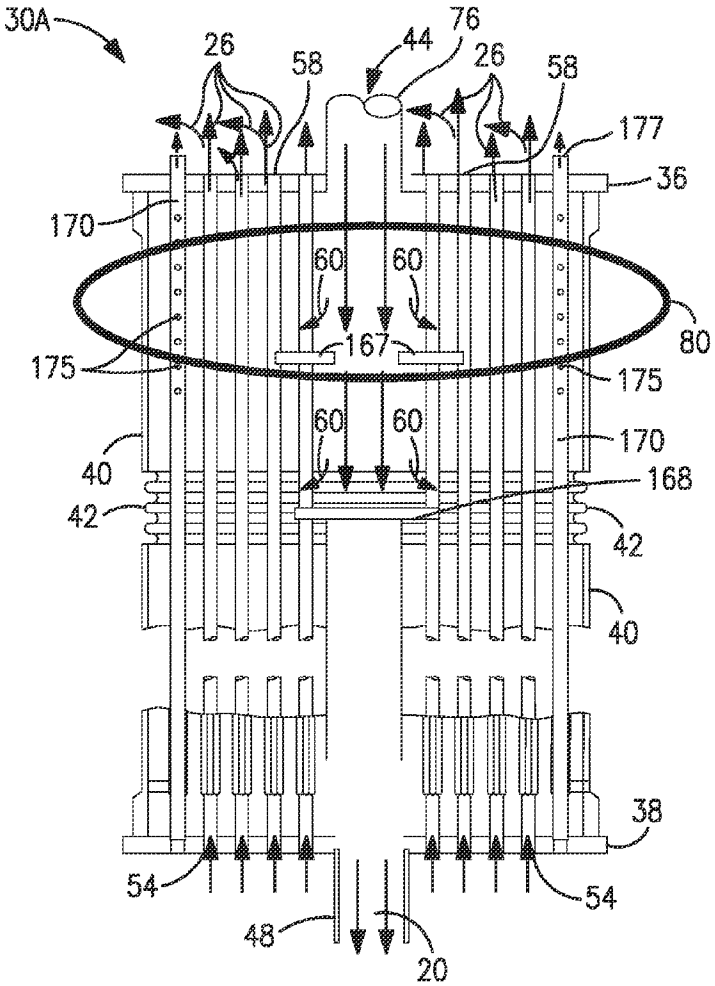
FIG. 17 is an elevational sectional view of a further alternate embodiment of the condenser-reboiler module with a downflow type arrangement for boiling of a liquid oxygen stream and up-flow of the nitrogen vapor.
Figure 18:
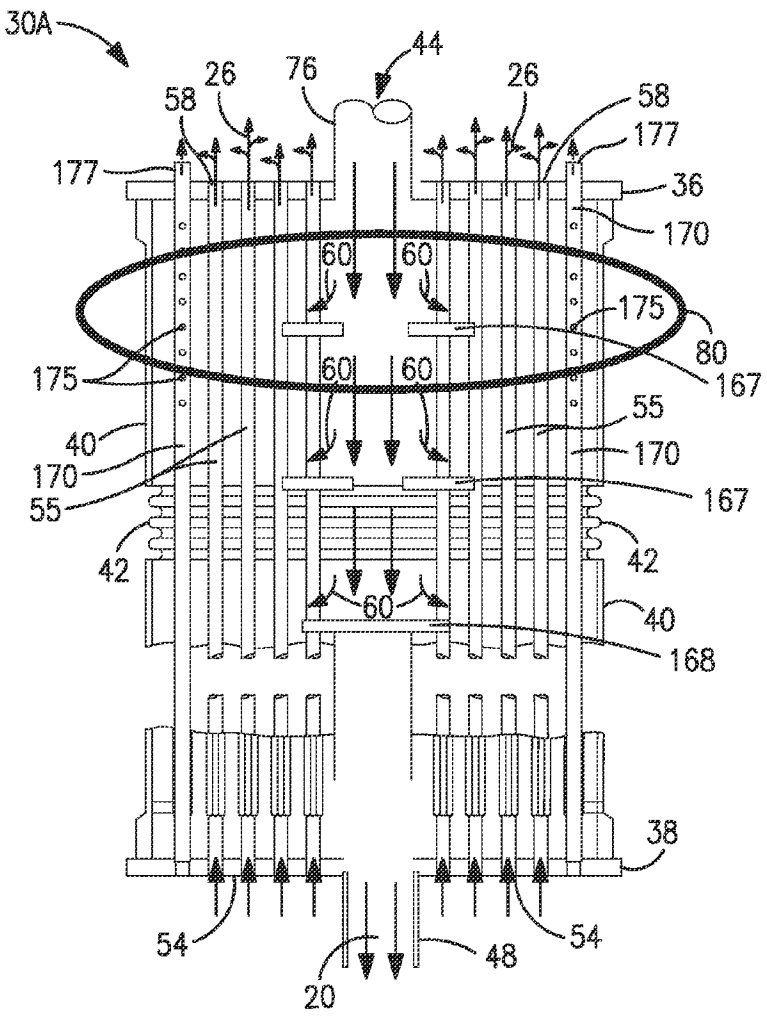
FIG. 18 is an elevational sectional view of an alternate embodiment of the condenser-reboiler module with a downflow type arrangement for boiling of a liquid oxygen stream and up-flow of the nitrogen vapor.

Turning now to FIG. 17 and FIG. 18, there is shown still further embodiments of the heat exchanger 30A. As with the previously discussed embodiments of FIGS. 13 and 14, the condensing medium inlet is located at or near the top of the condenser-reboiler module and tubesheet 36. As with the other embodiments, the condensing medium is preferably a nitrogen rich vapor that is directed from the upper portion of the higher pressure column via inlet conduit 76 within the shell 40 towards the lower portion of the heat exchanger 30A. The down-flowing condensing medium encounters a full impingement plate 168 that is centrally disposed within the shell 40 at a vertically intermediate location of the housing. The full impingement plate 168 is configured to radially distribute the flow of the nitrogen-rich vapor in a generally upward and radially outward direction towards the condensing surfaces. Additionally, one or more baffle plates 167 with varying open areas are shown centrally disposed within the shell 40 to deflect or urge a portion of the nitrogen rich vapor within the shell 40 in an outward radial direction toward the condensing surfaces on the condensing tubes 55.

As shown in FIG. 18, the full impingement plate 168 could be moved to a lower location in the housing to create the required flow distribution that pushes the aggregation of non-condensables, referred to as the non-condensable bubble, towards the top portion of the housing without exceeding flooding limits. Moving the full impingement plate 168 to a lower location within the housing may also help to provide higher flow areas and to reduce the pressure drop in larger diameter condenser modules. Moving the full impingement plate to a lower position allows for use of additional baffle plates 167. The additional baffle plates 167 deflect additional condensing medium in the radial outward direction and therefore direct a larger amount of the non-condensables entrained in the deflected flow further towards the periphery of the condenser module and at higher vertical locations. It has been found that the use of the additional open area baffle plates 167 minimizes heat transfer area binding with non-condensables, particularly at the condensing surfaces disposed at lower locations in the housing. The full impingement plate 168 and open area baffle plates 167 shown in FIG. 17 and FIG. 18 may also serve as a central support member for the innermost array of condensing tubes 55.

The embodiments of FIGS. 3-18 all include a one or more vents or vent passages 70 disposed at or near the top of the heat exchanger 30A, 30B and configured to continuously remove the accumulated non-condensables from within the one or more condenser-reboiler modules. In some embodiments, the vent passages 70 may be opened and/or closed with vent control valves (not shown) that are operatively associated with the vent passages 70. When opened, any non-condensable substances and accumulated non-condensables are discharged from the condenser-reboiler module 14. The illustrated vent passages 70 are shown disposed all along the top of the heat exchanger 30A, 30B and shown penetrating the tubesheet 36 from the central portion to the peripheral edges.

Figure 19:
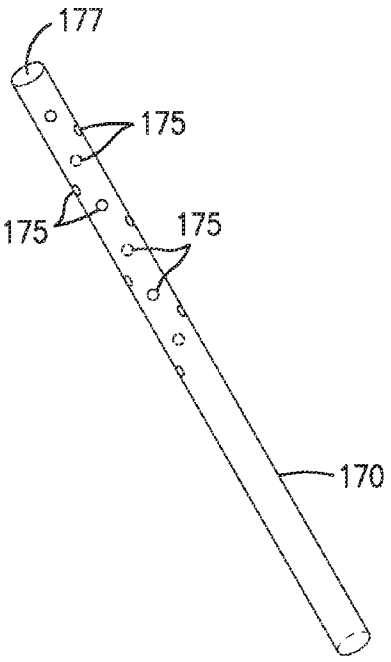
FIG. 19 is a perspective view of a preferred embodiment of a perforated vent tube used in various embodiments of the condenser-reboiler.

Other embodiments use perforated vent tubes 170 as vent passages as shown in FIGS. 17 through 19. Such perforated vent tubes 170 are disposed at the periphery of the tube bundle where the non-condensables such as helium and neon will generally accumulate. The total number of perforated vent tubes 170 depends on module size of the condenser as the radial distance or spacing between two adjacent perforated vent tubes should preferably be the same in order to maintain effective non-condensable removal.

Each perforated vent tube 170 has multiple orifices 175 disposed circumferentially around the cylindrical shaped tube and proximate the uppermost section of the tube to provide more cross-sectional flow area for vent flow which reduces the pressure drop of the vent flow. In addition, the cross sectional flow area for the vent flow is evenly and uniformly distributed in both peripheral and axial directions. In the illustrated embodiment, multiple ⅛ inch holes are drilled in the top or uppermost section of the cylindrical tube with equal vertical distance between the holes and peripherally rotating about 90° from any adjacent holes. The plurality of perforated vent tubes 170 are disposed in a vertical orientation extending between the two opposed tube sheets and generally parallel to the condensing tubes. Each perforated vent tube 170 penetrates or extends through the uppermost tubesheet 36 and has an open end 177 that is positioned along the top of the heat exchanger, as shown. This arrangement is particularly advantageous for neon recovery in air separation applications because the lower pressure drop or delta pressure of the nitrogen-rich vapor flow through the condenser provides more temperature driving force for condensing the nitrogen while leaving the resulting vent stream enriched with crude neon.

While the present invention has been characterized in various ways and described in relation to preferred embodiments, as will occur to those skilled in the art, numerous, additions, changes and modifications thereto can be made without departing from the spirit and scope of the present invention as set forth in the appended claims.

What is claimed is:

1. A condensation and vaporization system for a distillation column air separation unit comprising:

one or more condenser-reboiler modules having a housing defining a top, a bottom, one or more lateral sides, an upper portion, and a lower portion, the one or more condenser-reboiler modules disposed within a lower pressure column and configured to receive a condensing medium at a condensing inlet, an oxygen-rich liquid from the lower pressure column at an oxygen-rich liquid inlet, and further defining a condensate outlet proximate the bottom and an oxygen-rich effluent outlet;

a heat exchanger disposed in the one or more condenser-reboiler modules, the heat exchanger configured to partially vaporize the oxygen-rich liquid forming an oxygen-rich effluent and condense the condensing medium forming a condensate;

wherein the condensing medium is released within the heat exchanger in the condenser-reboiler modules and flows in an upward and radial outward direction within the one or more condenser-reboiler modules and non-condensables present in the condensing medium accumulate proximate the upper portion or top of the one or more condenser-reboiler modules; and one or more vents disposed proximate to the periphery of the one or more condenser-reboiler modules and configured to remove the accumulated non-condensables from within the one or more condenser-reboiler modules;

wherein the one or more vents further comprise a plurality of perforated tubes disposed proximate the periphery of the housing and extending vertically proximate the lateral sides thereof.

2. The system of claim 1 wherein the one or more vents are disposed proximate the upper portion or top of the housing.

3. The system of claim 1 wherein each of the perforated tubes further comprise:

a tubular shaped body defining an open end, an outer surface and an interior space and having a plurality of apertures or holes from the outer surface to the interior space; and wherein the perforated tubes are configured to be in contact with the condensing medium such that non-condensables in the condensing medium are conveyed through the holes into the interior space and vented from the condenser-reboiler modules via the open end.

4. The system of claim 3 wherein the open end of the perforated tubes is disposed proximate the upper portion or top of the housing.

5. The system of claim 3 wherein the apertures or holes are disposed around the periphery of the outer surface of the tubular shaped body.

6. The system of claim 3 wherein the apertures or holes are disposed on the uppermost portion of the tubular body proximate the open end.

7. The system of claim 1 wherein the heat exchanger is a shell and tube heat exchanger comprising:

two opposed tube sheets;

a cylindrical shell connecting the two opposed tube sheets; and a plurality of condensing tubes extending between the two opposed tube sheets for indirectly exchanging heat between the oxygen-rich liquid flowing within the plurality of tubes and the condensing medium flowing upward and radially outward within the cylindrical shell.

8. The system of claim 1 wherein the heat exchanger is a thermosiphon heat exchanger and the oxygen-rich liquid inlet is disposed proximate the bottom of the condenser-reboiler module and the oxygen-rich effluent outlet is disposed proximate the top of the housing for the one or more condenser-reboiler modules, and wherein the oxygen-rich liquid at the bottom of the lower pressure column is supplied to the condenser-reboiler module for re-boiling.

9. The system of claim 1 further comprising an impingement plate centrally disposed in a central portion or lower portion of the housing for the one or more condenser-reboiler modules and configured to deflect the flow of the incoming condensing medium to radially disperse the condensing medium to condensing surfaces of the condensing tubes.

10. The system of claim 9 further comprising a plurality of baffle plates centrally disposed in the housing above the impingement plate and configured to deflect or diffuse a portion of the condensing medium to radially disperse the portion of the condensing medium and disperse the non-condensables towards the perforated tubes disposed proximate the periphery of the housing.

11. The system of claim 9 wherein the condensing medium inlet is disposed at the top or the lateral side of the housing and directed via a conduit to the impingement plate.

12. The system of claim 1 further comprising a non-condensable recovery system coupled to the perforated tubes and configured to purify and recover the removed non-condensables.

* * * * *